/16/88 OR 4,725,096

United States Patent [19]

Leppänen

[11] Patent Number: 4,725,096

[45] Date of Patent: Feb. 16, 1988

[54] METHOD OF AND A DEVICE FOR CARRYING OUT WIRE BOLTING

[75] Inventor: Jarmo Leppänen, Ylöjärvi, Finland

[73] Assignee: Oy Tampella AB, Tampere, Finland

[21] Appl. No.: 919,020

[22] Filed: Oct. 15, 1986

[30] Foreign Application Priority Data

Nov. 7, 1985 [FI] Finland ..... 854376

[51] Int. Cl.[4] ..... E21C 41/00; E21D 21/00

[52] U.S. Cl. ..... 299/13; 299/11; 405/259

[58] Field of Search ..... 405/258–261, 405/288, 303; 299/11, 13; 148/12 B, 12.4, 143–145

[56] References Cited

U.S. PATENT DOCUMENTS

| | | | |
|---|---|---|---|
| 1,969,324 | 8/1934 | Poulter . | |
| 1,982,610 | 11/1934 | Harris . | |
| 2,055,885 | 9/1936 | Weston . | |
| 2,176,891 | 10/1939 | Crom . | |
| 2,274,883 | 3/1942 | Brach . | |
| 2,286,904 | 6/1942 | Ewald . | |
| 2,544,119 | 3/1951 | Wolfe . | |
| 2,692,092 | 10/1954 | Kinginger . | |
| 2,930,199 | 3/1960 | Jarund . | |
| 2,985,404 | 5/1961 | Tashiro . | |
| 3,225,974 | 12/1965 | Athas . | |
| 3,273,813 | 9/1966 | George . | |
| 3,379,019 | 4/1968 | Williams . | |
| 3,436,923 | 4/1969 | Lagerstrom . | |
| 3,520,725 | 7/1970 | Hamrick . | |
| 3,593,943 | 7/1971 | Collmann . | |
| 3,608,710 | 9/1971 | Pugh . | |
| 3,744,734 | 7/1973 | Lodato et al. . | |
| 3,809,333 | 5/1974 | Lefever . | |
| 3,815,845 | 6/1974 | Rygiol . | |
| 3,949,778 | 4/1976 | Woodford et al. . | |
| 3,999,391 | 12/1976 | Meredith . | |
| 4,040,329 | 8/1977 | Ljunberg . | |
| 4,066,093 | 1/1978 | Egerstrom . | |
| 4,079,592 | 3/1978 | Eakin | 405/260 |
| 4,085,492 | 4/1978 | Stange . | |
| 4,116,368 | 9/1978 | Smith . | |
| 4,151,965 | 5/1979 | Manabe . | |
| 4,253,813 | 3/1981 | Farrell, Jr. . | |
| 4,278,363 | 7/1981 | Choi . | |
| 4,289,427 | 9/1981 | Rolston . | |
| 4,305,553 | 12/1981 | Coquerel . | |
| 4,344,553 | 8/1982 | Lesher et al. . | |
| 4,453,679 | 6/1984 | Thuries et al. . | |
| 4,461,600 | 7/1984 | Norkus et al. . | |
| 4,514,111 | 4/1985 | Issakainen . | |
| 4,589,803 | 5/1986 | Totten | 405/259 |
| 4,601,518 | 7/1986 | Lanéus | 405/259 X |
| 4,615,234 | 10/1986 | Chevance et al. . | |
| 4,617,715 | 10/1986 | Koistenen et al. | 405/259 X |
| 4,624,400 | 11/1986 | Zimmer . | |
| 4,643,619 | 2/1987 | Issakainen . | |

FOREIGN PATENT DOCUMENTS

| | | | |
|---|---|---|---|
| 2526242 | 12/1976 | Fed. Rep. of Germany | 405/259 |
| 1460292 | 10/1966 | France . | |
| 1367404 | 9/1974 | United Kingdom . | |

*Primary Examiner*—Nancy J. Stodola

*Attorney, Agent, or Firm*—Birch, Stewart, Kolasch & Birch

[57] ABSTRACT

A method for carrying out wire bolting for bolting a rock, in which method drill holes are drilled in the rock through an ore body, and a wire is pushed into the holes. In order that the wires would not hamper the emptying of the ore body, the wire is weakened before it is passed into the hole at least at one point in such a manner that the wire breaks at the weakened point when the ore is blasted.

15 Claims, 6 Drawing Figures

PRIOR ART

METHOD OF AND A DEVICE FOR CARRYING OUT WIRE BOLTING

This invention relates to a method for carrying out wire bolting for bolting a rock, wherein drill holes are drilled in a rock through an ore body, and a wire is pushed into the drill holes.

In mechanized rock bolting, it is known to use a continuous wire as a bolt for the drill hole. The holes are drilled in the rock by means of an extension rod drilling equipment, whereafter a wire is pushed into the hole, which is filled with concrete either in advance or simultaneously. The wire usually consists of a string cord which is rich in carbon and has a high tensile strength.

The function of wire bolting is to support and reinforce the borders of an ore field and the supporting pillars left between the ore bodies in underground excavation as well as the ceiling of the ore body in cut-and-fill stoping. In the excavation carried out above the ground, wires can be used for supporting steep rock fronts.

When a rock is bolted by means of wires passed into the ore body or therethrough, some major problems are caused by the wires remaining within the ore in connection with the blasting of the ore and the emptying of the ore after the blasting. Since the wires are not broken during the blasting, they may tear off loose rock outside the ore body. The blasting does not always entirely break the ore loose from the wires but blocks of different sizes remain stuck to the wires. The wires and the blocks stuck thereto regard and hamper the emptying of the ore body, and they can even prevent it from being emptied, thus causing considerable costs. After the ore body has been emptied, wires remain hanging therein, and large blocks may adhere thereto. When the wire and the connection between the blocks and the wire are weakened by corrosion, the blocks begin to drop from the walls of the ore body, and the mine must be closed for security reasons. In so called cut-and-fill stoping, wires having a length corresponding to the depth of the blasted layer of ore remain hanging from the ceiling after the blasting, and these wires must be cut off before a subsequent blasting.

In order to avoid these problems it is previously known to excavate tunnels in the rock on the sides of the ore body, whereby those parts of the rock which adjoin to the ore body are bolted from these tunnels. However, the direction of the bolts thereby essentially equals to the direction of the border surface to be supported so that the supported surface tends to fall into the ore body. The bolts are not exposed to any traction, either.

It is also known to excavate tunnels in the rock outside the ore body, the wires being bolted into the rock adjacent the ore body from within said tunnels. It is thereby necessary to excavate tunnels for the bolting, and the hole lengths as well as the bolt lengths are made large in order to minimize the number of the tunnels.

SUMMARY OF THE INVENTION

A primary object of the present invention is to provide a method which avoids the above-mentioned disadvantages and enables the rock to be bolted by means of wires going through the ore body without thereby hampering the loosening of the ore and the emptying of the ore body. This object is achieved by means of a method according to the invention, which is characterized in that the wire is weakened at least at one point before it is pushed into the hole so that the wire is broken at the weakened point by the action of a blasting.

The invention is based on the idea that the rock is bolted through the ore body as previously while those portions of the wires are positioned within the area of the ore body are made such that they are broken by the action of a blasting so that they do not hamper the further treatment of the ore body. For this purpose, the wires are arranged to break when exposed to the strains caused by the blasting, e.g. at a point adjacent the border surface of the ore body and possibly at several points within the ore body. In cut-and-fill stoping, the wires can be such that they break e.g. at five meters intervals at the border surfaces of the blastings.

The simplest, easiest and most inexpensive way of weakening the wire is local hardening thereof. The wire is heated red-hot and thereafter cooled so that the wire material, rich in carbon, will be quenched hard and easily breakable. The bending, traction and shearing forces caused by the blasting break the wire at the weakened points.

When the wire is weakened through hardening, the appearance thereof is not altered, no points of discontinuity, sharp edges or the like are formed; the only effect is that the strength is weakened at the hardened point. A weakened wire can be pushed into the drill hole similarly as an unweakened one.

Furthermore, the hardening can be carried out rapidly. For example, resistance, induction or flame heating and cooling with e.g. water or some other medium takes only a few seconds. The weakening of a wire through hardening can be simply mechanized, and it can be carried out in connection with the bolting step.

The invention is thus also concerned with a wire bolting device intended for applying the method according to the invention, which device comprises a wire magazine and a feeding mechanism for passing a wire from the magazine into the drill hole. The device is characterized by hardening means positioned in the path of the wire for local weakening of the wire.

BRIEF DESCRIPTION OF THE DRAWINGS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will be described more fully in the detailed description given below and with reference to the attached drawing which are given by way of illustration only, and thus are not limitative of the present invention, and wherein.

DETAILED DESCRIPTION OF THE PREFERRED EMBODIMENTS

Figure 1:
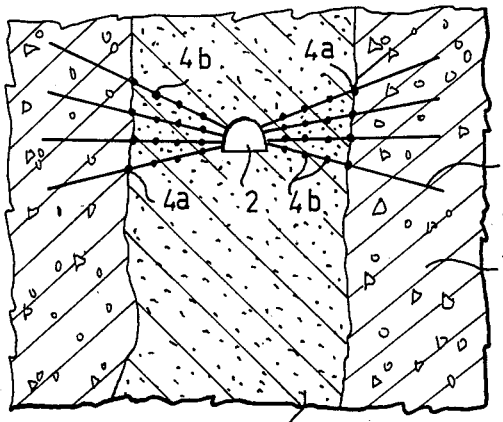
FIGS. 1 to 3 are schematic cross-sectional view of three different ways of carrying out the bolting method according to the invention.

In the bolting case shown in FIG. 1 of the drawing, the bolting is carried out from within an ore body 1 and through it. Tunnels 2 are formed in the ore body 1 for the drilling of the blasting holes. Holes are drilled in a surrounding rock 3 from within the tunnel through the ore body, and a wire 4 is pushed into each hole and fastened therein so that it extends uninterruptedly from the tunnel to the bottom of the drill hole.

Weakened points 4*a* and 4*b* are formed on the wires by hardening. After the wires have been passed into the drill holes, these weakened points are positioned on one hand at the border surface of the ore body and on the other hand at determined intervals along the distance between the border surface and the tunnel. The hardening of the wire is preferably carried out by electric heating and water cooling during the bolting step. The positions of the weakened points on the wires are selected on the basis of the charted borders of the ore body, the position of the tunnel, the bolting direction, etc. so that they will be positioned at predetermined points in the drill holes.

Figure 2:
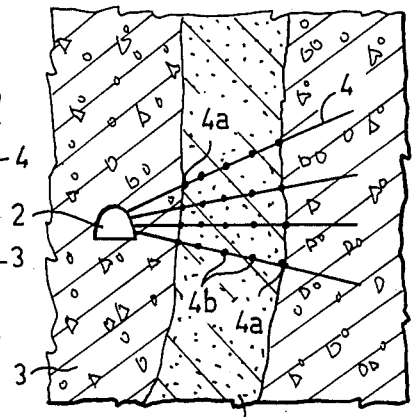

In the bolting case shown in FIG. 2, a number of holes is drilled from within the tunnel 2 positioned beside the ore body 1 through the ore body and further into the adjoining rock walls, and the holes are bolted by means of wires 4 from within the tunnel. The wires are provided with weakened points 4*a* and 4*b* at points corresponding to the position of the border surfaces of the ore body and corresponding to the desired breaking points within the ore body.

Figure 3:
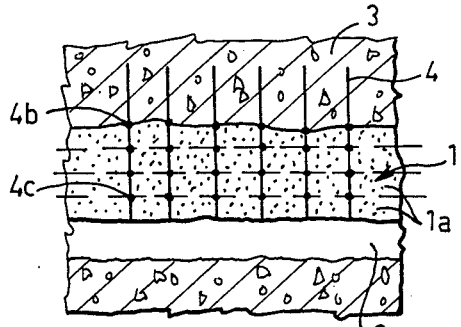

The bolting case shown in FIG. 3 illustrates cut-and-fill stoping of an ore body, wherein wires 4 having a length of e.g. 25 m are bolted into holes drilled in an ore body positioned above a tunnel 2. The wires are provided with weakened points 4*c* e.g. at intervals of 5 meters, which weakened points are positioned at the blast surfaces of the different ore layers 1*a*. One ore layer at a time is thereby blasted off the ore body.

It is noted that by virtue of the weakened points of the wires the wires are broken into pieces in such a manner that there remains no longer wire parts projecting from the rock walls defining the ore body, and no major ore blocks remain hanging from the wires. The wires within the ore are also broken into smaller pieces so that they do not hamper the emptying of the ore body.

Figure 4:
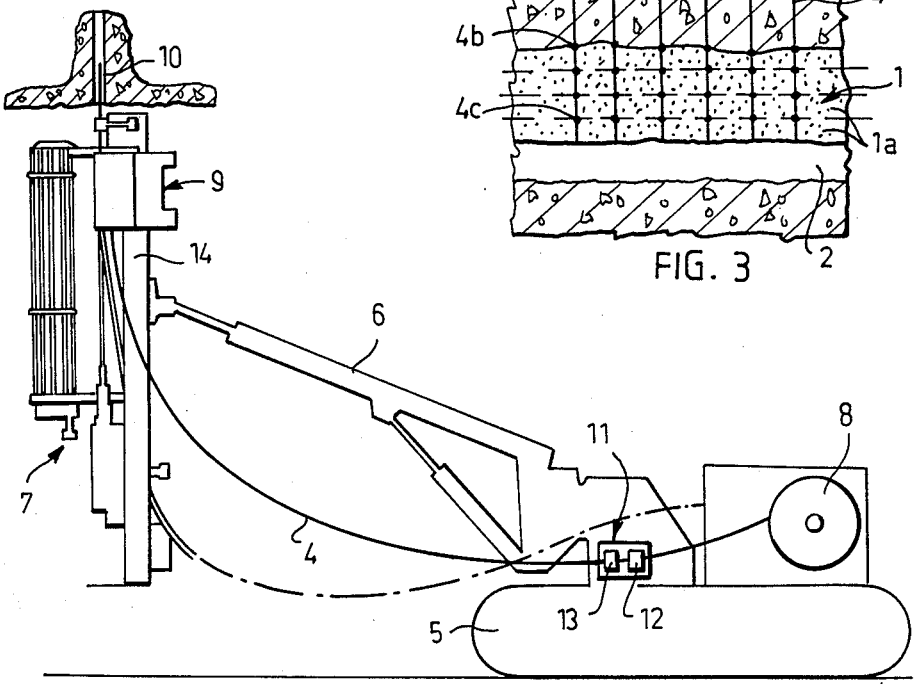
FIG. 4 is a side view of a rock bolting device whereto the invention has been applied.

The wire bolting device shown in FIG. 4 is of a structure known per se and comprises a carrier 5 which supports a bolting equipment 7 through a boom system 6. The carrier supports a wire magazine 8, and a feeding mechanism 9 is mounted in connection with the bolting equipment for feeding a wire 4 into a hole 10 drilled in the rock.

According to the invention hardening means 11 are mounted on the carrier, through which means the wire is passed and which comprises electric heating means 12 and water cooling means 13. The hardening means can, of course, be mounted somewhere else, e.g. on a feeding beam 14 of the bolting equipment.

Figure 5:
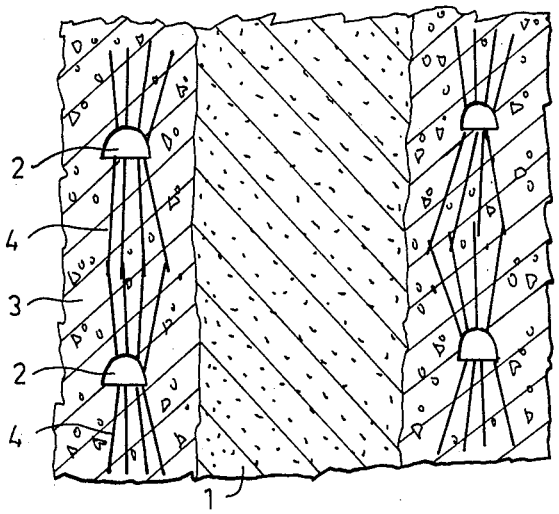
FIGS. 5 and 6 illustrate schematically two prior bolting method.
Figure 6:
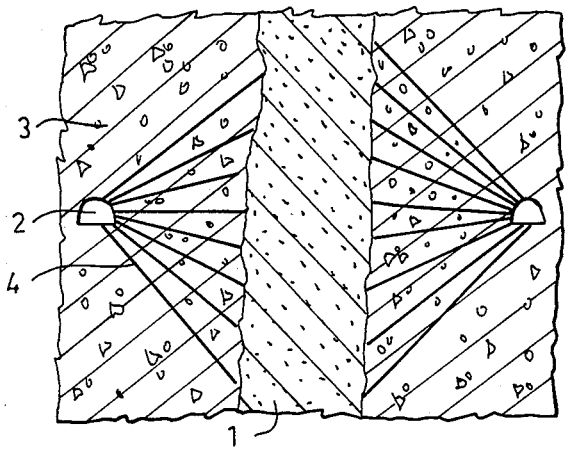
FIG. 6 PRIOR ART

FIGS. 5 and 6 illustrate prior bolting methods which are applied when the rock adjoining to an ore body is to be supported in such a manner that no disadvantageous wire parts remain within the ore body. As shown in FIG. 5, tunnels are formed on the side of the ore body, and the rock is bolted from within these tunnels in the direction of the ore body. In accordance with FIG. 6, tunnels are formed outside the ore body, and the rock is bolted from within these tunnels towards the ore body. The disadvantages of these known methods are disclosed at the beginning of the description.

The drawing and the description related thereto are only intended to illustrate the idea of the invention. In their details, the method and the device according to the invention may vary within the claims. So it is possible to apply other ways of weakening in place of hardening, even though weakening through hardening is particularly advantageous. It is also possible to make the weakened point by cutting part of the strings of the wire cord or by welding weakening pieces at some points on the wire.

Even though it has been stated above that the wire pushed into the hole always has the same length as the hole, it is possible in certain bolting cases to push into one or more holes a wire which is shorter than the drill hole and, however, longer than the hole in the rock to be supported so that the wire goes as far as the ore body for the temporary support thereof during the different blasting steps. Thereby it is not necessary that the wire extends e.g. into that part of the hole which is positioned in that ore layer of the body which is to be blasted off first, which decreases the material costs.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for carrying out wire bolting for bolting a rock, comprising the steps of:

drilling drill holes in a rock through an ore body; and pushing a wire into the drill holes;

said methods further comprising the step of weakening the wire at least at one point before pushing it into one of the drill holes so that the wire is broken at the weakened point during blasting.

2. A method according to claim 1, wherein the weakening of the wire is carried out by hardening.

3. A method according to claim 1, wherein the wire is weakened at least at a point essentially corresponding to the border surface of a ore body.

4. A method according to claim 3, wherein the weakening of the wire is carried out by hardening.

5. A method according to claim 3, wherein the wire is weakened at several mutually spaced points over that part of the wire which remains within the ore body.

6. A method according to claim 5, wherein the weakening of the wire is carried out by hardening.

7. A wire bolting device, comprising:

a wire magazine; and a feeding mechanism for passing a wire along a feed path from the magazine to a drill hole;

said device further comprising hardening means provided in said feed path of the wire for local weakening of the wire.

8. A device according to claim 7, wherein the hardening means are positioned in the immediate vicinity of the feeding mechanism.

9. A device according to claim 8, wherein the hardening means comprise means for heating the wire and means for feeding a cooling medium, to the heated point of the wire.

10. A device according to claim 9, wherein the cooling medium comprises water.

11. A device according to claim 7, wherein the hardening means are positioned on a carrier.

12. A device according to claim 11, wherein the hardening means comprise means for heating the wire and means for feeding a cooling medium, to the heated point of the wire.

13. A device according to claim 12, wherein the cooling medium comprises water.

14. A device according to claim 7, wherein the hardening means comprise means for heating the wire and means for feeding a cooling medium, to the heated point of the wire.

15. A device according to claim 14, wherein the cooling medium comprises water.

* * * * *